United States Patent [19]

Yamaguchi et al.

[11] 4,141,762

[45] Feb. 27, 1979

[54] TWO-PHASE STAINLESS STEEL

[75] Inventors: Shigehiro Yamaguchi, Fujisawa; Hisashi Kobayashi, Yokohama, both of Japan

[73] Assignee: Nippon Steel Corporation, Tokyo, Japan

[21] Appl. No.: 797,115

[22] Filed: May 16, 1977

[30] Foreign Application Priority Data

May 15, 1976 [JP] Japan ..... 51-55754
May 25, 1976 [JP] Japan ..... 51-60392

[51] Int. Cl.[2] ..... C22C 38/06; C22C 38/42; C22C 38/48; C22C 38/58

[52] U.S. Cl. ..... 148/37; 75/122; 75/124; 75/125; 75/128A; 75/128 C; 75/128 N; 75/128 E; 75/128 G; 75/128 T; 75/128 W; 148/38

[58] Field of Search ..... 148/37, 38; 75/122, 75/134 F, 124, 125, 128 A, 128 N, 128 C, 128 E, 128 R, 128 G, 128 T, 128 W

[56] References Cited

U.S. PATENT DOCUMENTS

| | | | |
|---|---|---|---|
| 3,362,813 | 1/1968 | Ziolkowski | 75/128 A |
| 3,785,787 | 1/1974 | Yokota et al. | 75/125 |
| 3,795,507 | 3/1974 | Allen | 75/125 |
| 3,837,846 | 9/1974 | Becker et al. | 75/124 |
| 3,865,644 | 2/1975 | Hellner et al. | 75/124 |
| 3,989,514 | 1/1976 | Fujioha et al. | 75/124 |
| 4,007,038 | 2/1977 | Deverell | 148/38 |
| 4,032,367 | 6/1977 | Richardson et al. | 148/38 |
| 4,043,838 | 8/1977 | Deverell | 148/38 |

*Primary Examiner*—Arthur J. Steiner
*Attorney, Agent, or Firm*—Wenderoth, Lind & Ponack

[57] ABSTRACT

A two-phase stainless steel containing 10 – 75% ferrite and an effective sulfur content controlled to 0.003% by weight or lower and an effective phosphorous content controlled to 0.01% by weight or lower.

1 Claim, 3 Drawing Figures

No. 1 Steel

No. 7 Steel

TWO-PHASE STAINLESS STEEL

BACKGROUND OF THE INVENTION

1. Field of the Invention

The present invention relates to a two-phase stainless steel containing 10–75% ferrite with the balance being austenite and having a remarkably excellent hot workability.

2. Description of the Prior Art

In recent years, two-phase stainless steels have been increasingly used in various applications for their excellent corrosion resistance, particularly stress corrosion resistance, and their excellent resistance to welding cracks. However, simply because the two-phase stainless steels contain simultaneously the ferrite phase and the austenite phase, they are more susceptible to the interfacial cracking between the ferrite phase and the austenite phase during the hot workings, such as the break-down rolling and the hot rolling, and it has been well known as taught by A. Gueussier and R. Castro in "Metal Treatment and Drop Forging;" October (1959) 361, that their hot workability deteriorates remarkably when the ferrite is present in an amount from 10 to 75%. For this reason, two-phase stainless steels show a very low yield ratio in the break-down rolling and the hot rolling, and even if some improvement of yield ratio can be attained on the break-down forging, they have been still confronted with operational and economical disadvantages.

Therefore, improvement of the hot workability of two-phase stainless steels has long been strongly sought for in the steel making industry.

Conventionally, sulfur and phosphorus contained as impurities in stainless steels are present usually in an amount from 0.006 to 0.02%(S) and in an amount from 0.01 to 0.03%(P) without a special melting method, such as "Electro-slag Remelting Process" and "Electro-slag Refining Process" using metallic Ca-CaFe slag as disclosed in U.S. Pat. No. 3,879,192 [hereinafter called "MSR Process" (Metal Bearing Solution Process)], or a special refining method such as "AOD" (Argon-Oxygen Decarburization) process developed by Union Carbide Corp., or strict selection of the raw materials.

Sulfur and phosphorus contents as impurities in the above ranges do not substantially produce adverse effect on the hot workability in case of ferritic stainless steels, and also in case of austenitic stainless steels, their adverse effect is not so remarkable. However, in case of two-phase stainless steels, sulfur and phosphorus contents even in the above ranges deteriorate the hot workability remarkably.

SUMMARY OF THE INVENTION

Therefore, one of the objects of the present invention is to provide a two-phase stainless steel having an excellent hot workability and a high yield ratio by eliminating the adverse effects of sulfur and phosphorus on the hot workability.

In the present invention, the amount of effective sulfur contained in the steel which adversely affects the hot workability is lowered to 0.003% by weight or lower by using rare earth elements, Ca or Mg. At the same time, the total phosphorus content in the steel is lowered to 0.01% or lower, or when the total phosphorus content is more than 0.01%, the phosphorus is fixed by Al, Ga, In or other elements of the IIIB group of the periodical table, so as to lower the effective phosphorus content which adversely affects the hot workability to 0.01% or lower, whereby a two-phase stainless steel having a remarkably improved hot workability is obtained.

Other objects and features of the present invention will be clear from the following descriptions referring to the attached drawings.

DETAILED DESCRIPTION OF THE INVENTION

The present inventors have studied extensively in view of the above facts and knowledges and have found that the susceptibility of two-phase stainless steels to cracking during the hot workability can be eliminated in spite of a total sulfur content of 0.03% or higher, when the sulfur content is fully fixed by addition of one or more of rare earth elements such as Y, Ce and La in an amount from 0.001 to 0.2%. This lowers the effective sulfur which produces an adverse effect on the hot working (herein called simply "effective sulfur") to 0.003% or less and at the same time the total phosphorus content is lowered to 0.01% or less. The sulfur is fully fixed by addition of one or both of 0.001 to 0.03% Ca, 0.001 to 0.09% Mg to lower the effective sulfur content to 0.003% or less and at the same time to lower the total phosphorus content to 0.01% or less.

Further, on the basis of the fact and knowledge that even when the total phosphorus content in the steel is more than 0.01%, the desired results can be obtained when the phosphorus is fixed so as to lower the effective phosphorus which produces an adverse effect on the hot workability (herein called simply "effective phosphorus"). The present inventors have conducted further extensive studies or various testing results of workability of two-phase stainless steels, and have found that the elements of the IIIB group of the periodical table are effective to fix phosphorus and thus eliminate the adverse effect of phosphorus on the hot workability.

Figure 1:
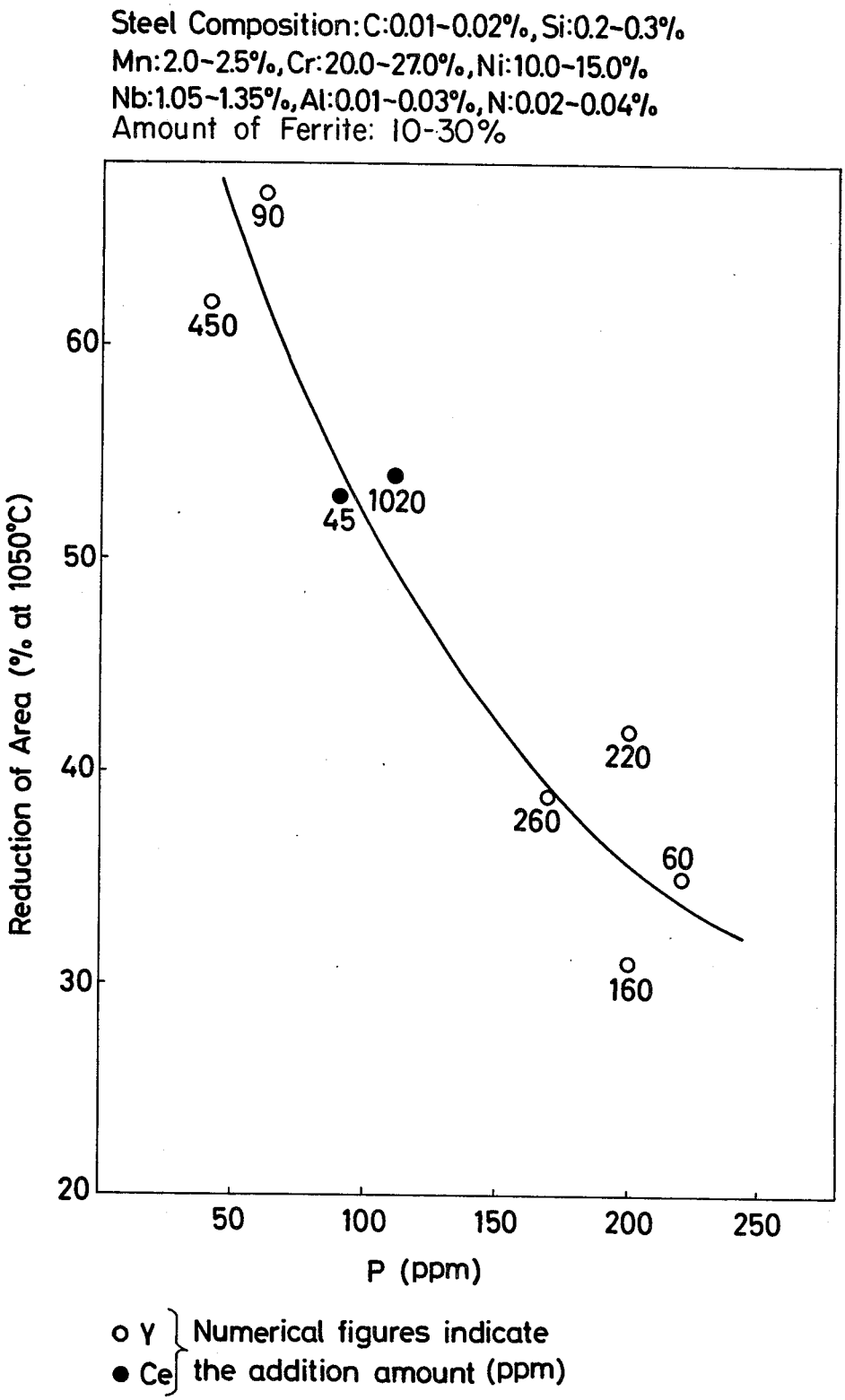
FIG. 1 is a graph showing the correlation between phosphorus contents and the reduction of area at 1050° C. in a stainless steel containing 10 to 30% ferrite which shows the worst hot workability.

In FIG. 1 showing Gleeble Testing (high-temperature high-speed tensile test) results of a two-phase stainless steel containing 10 to 15% ferrite phase with sulfur content fixed by the rare earth elements, reductions of area at 1050° C. for various phosphorus contents are shown. As clearly understood from the results, the hot workability is remarkably improved when the phosphorus content is 0.01% or less.

Microstructural observations of the crackings in two-phase stainless steels reveal that ferrite grains and austenite grains are present in mixture and the cracking during the hot working occurs at the interface between the ferrite grains and the austenite grains and expands through the grain boundaries.

As mentioned before, when the total phosphorus content is lowered to 0.01% or less by an ordinary refinement, or the total phosphorus when present more than 0.01%, is fixed by Al, Ga, In and other elements of the IIIB group, the workability is improved. The reasons are set forth below. When the effective phosphorus content is lowered the effective phosphorus content present in the grain boundaries is also lowered, thus remarkably increasing the intergranular bonding force around the austenite grains and the ferrite grains and between the ferrite grains and the austenite grains. Another reason is that the austenite phase and the ferrite phase have a different hot deforming ability due to the difference in the solubility of phosphorus in the ferrite phase and the austenite phase. Thus, when the effective phosphorus is present in a large amount, phosphorus tends to be dissolved in the ferrite grains more than in the austenite grains to remarkably harden the ferrite grains, so that the deforming ability at high temperatures is remarkably deteriorated. Therefore, as the solid solution phosphorus increases in the grain boundaries between the ferrite grains and the austenite grains, crackings are more apt to occur.

Meanwhile, when the sulfur content is excessive, the hot workability deteriorates. In order to eliminate the adverse effect of the sulfur content, it is necessary to fix the sulfur in the steel by Y, Ce, La or other rare earth elements or by Ca or Mg.

It is naturally possible to improve the hot workability of a two-phase steel by controlling the shape and distribution of the grains of the secondary phase appropriately corresponding to the quantitative proportion of the both phases having different deformation ability constituting the two-phase steel. However, ferrite grains containing a large amount of phosphorus are so stable that it is extremely difficult to vary the shape and distribution of the ferrite grains by heating treatments, and only a small improvement can be obtained thereby.

Therefore, it is essential to lower both the effective phosphorus content and the effective sulfur content simultaneously in order to improve the hot workability.

Hereinbelow explanations will be made on the reasons for limitations of the steel composition.

Sulfur is an impurity element normally contained in the steel, but it must be removed in order to improve the hot workability. However, sulfur contents in the amount as usually contained in a steel (not more than 0.03%) can be fixed fully by addition of Y, Ce, La or other rare earth element, or addition of Ca or Mg, so as to maintain the effective sulfur content in an amount not more than 0.003%, so that the adverse effect of sulfur can be eliminated. Therefore, the upper limit of the sulfur content is set at 0.03%. In view of addition yield of rare earth elements, Ca or Mg, etc. in commercial operations, the upper limit of sulfur is preferably set at 0.01%.

Phosphorus is also an impurity element normally contained in a steel, and when the total phosphorus content is not more than 0.01%, its adverse effect on the hot workability is diminished, but even when the total phosphorus is more than 0.01%, it can be fixed by Al or other elements of the IIIB group, so as to lower the effective phosphorus content which produces adverse effect on the hot workability to 0.01% or less, so that the hot workability can be improved. The fixing effect by Al and other IIIB group elements can be exerted so far as the total phosphorus is not larger than 0.08%. Therefore, the upper limit of the phosphorus content is set at 0.08%, preferably at 0.05% in view of the weldability.

Aluminum (as well as elements of the IIIB group such as Ga and In) is essential for fixing phosphorus so as to improve the hot workability. But less than 0.06% Al does not improve the hot workability, and its effect saturates at about 2% and remains unchanged until about 6%. Therefore, the upper limit of the aluminum content is set at 6%, preferably at 1.0% in view of the weldability. Meanwhile, in cases when aluminum is added only for the purpose of deoxidizing the steel, about 0.05% Al is enough.

Yttrium (as well as rare earth elements such as Ce and La) is essential for fixing sulfur so as to improve the hot workability, but less than 0.001% Y does not improve the hot workability. On the other hand, more than 0.2% Y rather deteriorates the hot workability. A preferable range for the yttrium content is from 0.01 to 0.09%. Rare earth elements other than Y, Ce and La are similarly effective to improve the hot workability, but Y, Ce and La are more preferable from an economical point of view.

Calcium and magnesium, just as the rare earth elements, are effective to improve the hot workability by fixing sulfur into CaS and MgS as inclusions. Calcium contents less than 0.001% do not produce the improvement but calcium contents more than 0.03% rather deteriorate the hot workability. Therefore, the upper limit of the calcium content is set at 0.03%. However, a preferable range is from 0.002 to 0.01%. Also magnesium contents less than 0.001% do not produce the improvement, but magnesium contents more than 0.09% rather deteriorate the hot workability. Thus, the upper limit for the magnesium content is set at 0.09%. A preferable and more effective range is from 0.008 to 0.03%.

The present invention is limited to a two-phase stainless steel containing 10 to 75% ferrite for the following reason. In case of ordinary austenitic stainless steel materials produced by an ordinary method, 2 to 3% of ferrite is usually allowed to be present in order to maintain the necessary alloying elements at their lowest levels within their required ranges for the purpose of lowering the production cost.

The main object of the present invention is to improve the hot workability of a stainless steel containing 10–75% of ferrite so as to expand the application field of the steel, which has hitherto been recognized to show a poor hot workability. Therefore, the present invention is not directed to stainless steels containing 2 to 3% of ferrite or more than 75% of ferrite.

Further explanations will be made hereinbelow on other elements constituting the two-phase stainless steel according to the present invention.

Carbon is an essential element for increasing the strength, and for this purpose at least 0.005% C is required. However, if carbon is present in excessive amounts it precipitates as carbides in the grain boundaries which deteriorate the hot workability. Therefore, the upper limit for the carbon content is set at 0.2%. A preferable range is from 0.01 to 0.08%.

Silicon is added during the steel making for deoxidation, and for this purpose at least 0.01% Si is required. Also it improves oxidation resistance at high temperatures in service, but more than 3% Si produces an adverse effect on the workability and weldability. Therefore the upper limit for the silicon content is set at 3%.

Manganese is added for the purposes of deoxidation and prevention of hot embrittlement. Further manganese is strongly effective to stabilize the austenite and thus can be used in substitution for costly nickel. However, excessive manganese contents cause deterioration of the oxidation resistance. Therefore the upper limit for the manganese content is set at 15%.

Chromium is required to be present in an amount of not less than 15% in order to improve the oxidation resistance, but excessive chromium contents cause susceptibility to the sigma embrittlement. Therefore, the chromium content is limited to an amount not more than 35%.

Nickel is effective to prevent the sigma embrittlement, carburization and nitrization. Excessive nickel contents do not produce any enhancement in effect, but only cause increased production cost. Therefore, the nickel content is limited to the range from 10 to 30%.

Niobium, similar as tantalum, is a strong carbide forming element, and when added in an amount of about ten times of the weight per cent of the carbon content, it improves the resistance to intergranular corrosion (tantalum has similar effect but one second (½) lower than niobium). Further niobium preferentially precipitates on the dislocation as fine carbide and nitride to improve high-temperature strength and creep property. However, excessive niobium contents cause deterioration of the hot workability. Therefore the upper limit of the niobium is set at 2%.

Molybdenum, when added in amounts more than 0.5%, gives remarkably excellent corrosion resistance to non-oxidizing acids. It also strengthen the matrix and enhances the high-temperature strength and the creep rupture strength. However, molybdenum contents more than 6% cause abnormal oxidation and remarkable deterioration of the high-temperature oxidation resistance, and saturate the above beneficial effects. Therefore, the upper limit of the molybdenum content is set at 6%.

Titanium is strongly effective for deoxidation, denitrization and desulfurization. Also it is a strong ferrite former, and when added in an amount four to six times of the carbon content by weight percent, prevents the intergranular corrosion. However, when titanium is present as precipitates or inclusions, pit corrosion resistance is remarkably deteriorated. Therefore, the upper limit of the titanium content is set at 1%.

Copper dissolves uniformly in the austenite up to about 3% and strengthens the matrix and increases the corrosion resistance to non-oxidizing acids. It also gives resistance to carburization and nitrization as well as resistance to oxidation. However, copper contents more than 3% deteriorate the hot workability. Therefore, the upper limit of the copper content is set at 3%.

Nitrogen, which is contained in stainless steels usually in an amount of about 0.01%, is a strong austenite former, and this can be used in substitution for nickel. Nitrogen can be added up to about 0.4%, and with a nitrogen content of about 0.4% under the atmospheric air, the deformation resistance increases remarkably and the hot working is hindered considerably. Therefore, the upper limit of the nitrogen content is set at 0.4%.

The present invention will be more clearly understood from the following descriptions of preferred embodiments of the present invention.

DESCRIPTION OF PREFERRED EMBODIMENTS

Sample materials as shown in Tables 1 and 2 were melted and samples were taken therefrom and their hot workability was determined by Gleeble tests (high-temperature and high-speed tensile testing) and continuous rolling tests using small block testing pieces (120 mm × 120 mm × 190 mm). S and P in the tables represent respectively the total sulfur content and the total phosphorus content. The ferrite amount in the tables was measured by the ferritometer.

Figure 2:
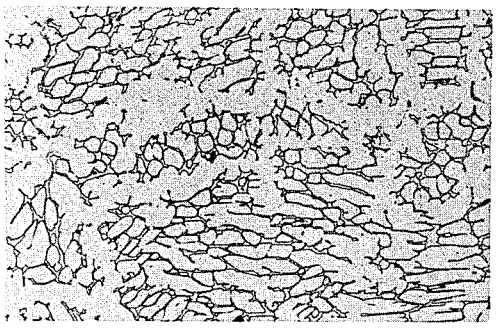
FIG. 2 is a typical microstructure of a comparative steel.

Meanwhile, microstructure photographs of 30 field of 0.12 $mm^2$ area in each steel were observed to measure the dimensional ratio of the ferrite, which was converted into a volumetric ratio to obtain an average ferrite amount. The ferrite amount measured by the ferritometer and the average ferrite amount were coincident with about 1% error. FIG. 2 is the typical microstructure of steel No. 1. Thus the ferrite amount measured by the photograph was 12.3% while the ferrite amount measured by the ferritometer was 11.5%.

Steel No. 7–No. 12 in Table 3 were subjected to Gleeble tests to determine effects of Y, Ce and La on the hot workability. Steels No. 1–No. 6 are comparative steels, and steels No. 7–No. 12 are in accordance with the present invention.

The steels No. 7–No. 12 according to the present invention, in which the effective sulfur is fixed fully by addition of the rare earth elements and a low phosphorus content is maintained by using low-phosphorus raw materials show remarkably improved ductility (reduction of area) as compared with the comparative steels No. 1 to No. 6. According to Gleeble testing results, it has been found through experiments that the level of reduction area as obtained by the steels No. 7 to No. 12 assures a satisfactory break-down rolling. Therefore, steels No. 7 to No. 12 can be safely broken down by rolling, whereas the comparative steels have a limited temperature range for satisfactory break-down rolling, and it is difficult to break-down these steels on a commercial scale.

Figure 3:
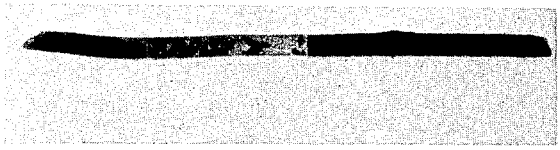
FIG. 3 is a photograph showing edge cracks appearing in a rolled product rolled from a comparative steel.
Figure 3:
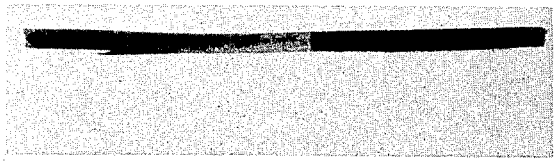

The photograph of FIG. 3 shows the edge cracks appearing in the rolled products rolled from the small block samples taken from steels No. 1 and No. 7 (120 mm to 20 mm by continuous 8 passes). Steel No. 7 shows no edge crack as expected from the result of Gleeble test, while steel No. 1 shows remarkable edge cracks.

Steels No. 13 to No. 18 shown in Table 3 were subjected to Gleeble tests to determine effects of Ca, Mg and P on the hot workability.

The steels No. 13 to No. 18 according to the present invention in which one or both of Ca and Mg is added to lower the effective sulfur and a low phosphorus content is maintained by using low-phosphorus raw materials show remarkably improved ductility (reduction of area) as compared with the comparative steels No. 1 to No. 6. Steels No. 13 to No. 18 can be satisfactorily broken down by rolling just as the steels No. 7 to No. 12.

Steels No. 25 to No. 30 in Table 3 were subjected to Gleeble tests to determine effects of the rare earth elements such as Y, Ce and La, and the IIIB group elements such as Al on the hot workability.

Comparative steels No. 19 to No. 24 in Table 2 contain a large amount of one or both of sulfur and phosphorus, while steels No. 25 to No. 30 are in accordance with the present invention.

It is clear that the steels No. 25 to No. 30 according to the present invention in which the rare earth elements are added to lower the effective sulfur content, and further the IIIB group elements such as Al are added to lower the effective phosphorus content have remarkably improved ductility (reduction of area) as compared with the comparative steels No. 19 to No. 24. According to the results of Gleeble tests the level of reduction of area as obtained by the steels No. 25 to No. 30 assures satisfactory break-down rolling. Therefore, these steels can be broken down by rolling satisfactorily. Whereas the comparative steels have a limited temperature range permitting the break-down rolling, and they can not be broken down easily on a commercial scale.

Steels No. 31 to No. 36 in Table 3 were subjected to Gleeble tests to determine effects of Ca, Mg and the IIIB group elements such as Al on the hot workability. These steels according to the present invention in which Ca and Mg are added to lower the effective sulfur content and further the IIIB elements such as Al are added to lower the effective phosphorus content have remarkably improved ductility (reduction of area) as compared with the comparative steels No. 19 to No. 24. The steels No. 31 to No. 36 can be broken down by rolling satisfactorily.

As described hereinbefore, the present invention has a great advantage in that the steels according to the present invention have remarkably improved hot workability, and can be easily and satisfactorily broken down by rolling. Particularly, the present invention has a remarkable economical advantage with respect to elimination of the adverse effect of phosphorus by addition of the IIIB group elements such as Al.

Table 1

| Steel Grade | | Composition C | Si | Mn | Cr | Ni | Cu | Mo | Al | N | Ti | Nb | P | S | Others | (Weight %) Amount of Ferrite |
|---|---|---|---|---|---|---|---|---|---|---|---|---|---|---|---|---|
| Comparison | No. 1 | 0.021 | 0.32 | 2.37 | 21.6 | 11.2 | — | — | 0.025 | 0.033 | 0.30 | 1.11 | 0.006 | 0.005 | — | 11.5 |
| | 2 | 0.056 | 1.20 | 13.4 | 33.8 | 10.3 | 2.0 | 5.2 | 0.025 | 0.35 | — | — | 0.004 | 0.005 | — | 15.3 |
| | 3 | 0.01 | 0.30 | 3.21 | 33.4 | 23.0 | — | — | 0.025 | 0.04 | 0.11 | — | 0.005 | 0.007 | — | 17.4 |
| | 4 | 0.049 | 0.53 | 1.54 | 17.6 | 10.1 | — | 5.16 | 0.03 | 0.017 | — | — | 0.023 | 0.006 | — | 21.0 |
| | 5 | 0.08 | 1.04 | 0.50 | 26.5 | 10.4 | 0.5 | — | 0.03 | 0.022 | 0.03 | 0.7 | 0.025 | 0.003 | — | 40.3 |
| | 6 | 0.11 | 2.00 | 2.50 | 31.6 | 10.4 | — | — | 0.03 | 0.03 | 0.52 | — | 0.022 | 0.001 | — | 63.2 |
| Present Invention | 7 | 0.024 | 0.33 | 2.38 | 21.4 | 11.4 | — | — | 0.025 | 0.034 | 0.30 | 1.21 | 0.006 | 0.006 | Y 0.011 Ce 0.023 La 0.021 | 11.6 |
| | 8 | 0.057 | 1.20 | 13.5 | 34.4 | 10.5 | 2.1 | 5.1 | 0.028 | 0.35 | — | — | 0.005 | 0.006 | Ce 0.06 | 16.3 |
| | 9 | 0.02 | 0.32 | 3.22 | 33.3 | 24.3 | — | — | 0.024 | 0.03 | 0.12 | — | 0.004 | 0.006 | Ce 0.05 La 0.023 | 17.8 |
| | 10 | 0.045 | 0.54 | 1.54 | 17.9 | 10.5 | — | 5.3 | 0.04 | 0.016 | — | — | 0.007 | 0.008 | Y 0.012 Ce 0.05 | 19.8 |
| | 11 | 0.09 | 1.04 | 0.51 | 27.4 | 10.4 | 0.8 | — | 0.03 | 0.024 | 0.04 | 0.9 | 0.005 | 0.007 | Y 0.06 | 41.4 |
| | 12 | 0.12 | 2.10 | 2.53 | 31.6 | 10.4 | — | — | 0.05 | 0.03 | 0.54 | — | 0.004 | 0.006 | Ce 0.054 | 62.1 |
| | 13 | 0.020 | 0.31 | 2.38 | 21.7 | 11.2 | — | — | 0.04 | 0.033 | 0.30 | 1.12 | 0.005 | 0.007 | Ca 0.009 | 11.8 |
| | 14 | 0.056 | 1.20 | 13.4 | 34.7 | 10.3 | 2.1 | 5.3 | 0.023 | 0.34 | — | — | 0.008 | 0.006 | Mg 0.021 | 15.7 |
| | 15 | 0.021 | 0.31 | 3.24 | 34.2 | 23.0 | — | — | 0.024 | 0.03 | 0.13 | — | 0.004 | 0.006 | Ca 0.005 Mg 0.009 | 17.5 |
| | 16 | 0.048 | 0.53 | 1.54 | 17.3 | 10.9 | — | 5.2 | 0.03 | 0.017 | — | — | 0.004 | 0.006 | Mg 0.024 | 21.3 |
| | 17 | 0.09 | 1.03 | 0.50 | 26.6 | 10.4 | 0.5 | — | 0.025 | 0.021 | 0.031 | 0.7 | 0.006 | 0.006 | Ca 0.007 | 41.3 |
| | 18 | 0.13 | 2.0 | 2.40 | 31.5 | 10.4 | — | — | 0.032 | 0.03 | 0.51 | — | 0.006 | 0.006 | Ca 0.005 | 65.1 |

Table 2

| Steel Grade | | Composition C | Si | Mn | Cr | Ni | Cu | Mo | N | Ti | Nb | P | S | Others | (Weight %) Amount of Ferrite |
|---|---|---|---|---|---|---|---|---|---|---|---|---|---|---|---|
| Comparison | 19 | 0.022 | 0.31 | 2.36 | 21.5 | 11.3 | — | — | 0.031 | 0.30 | 1.12 | 0.02 | 0.007 | — | 11.3 |
| | 20 | 0.057 | 1.2 | 13.6 | 33.7 | 10.4 | 2.0 | 5.3 | 0.34 | — | — | 0.02 | 0.005 | — | 15.5 |
| | 21 | 0.02 | 0.32 | 3.22 | 34.1 | 23.0 | — | — | 0.038 | 0.10 | — | 0.003 | 0.007 | — | 16.9 |
| | 22 | 0.050 | 0.51 | 1.53 | 17.7 | 10.1 | — | 5.20 | 0.018 | — | — | 0.02 | 0.006 | — | 22.0 |
| | 23 | 0.08 | 1.05 | 0.51 | 27.1 | 10.4 | 0.5 | — | 0.023 | 0.03 | 0.7 | 0.02 | 0.003 | — | 41.2 |
| | 24 | 0.11 | 2.10 | 2.52 | 31.7 | 10.4 | — | — | 0.03 | 0.50 | — | 0.03 | 0.004 | — | 63.1 |
| Present Invention | 25 | 0.025 | 0.35 | 2.40 | 21.6 | 11.3 | — | — | 0.04 | 0.30 | 1.23 | 0.02 | 0.008 | Y 0.012; Ce 0.025; La 0.022; Al 0.1; In 0.4 | 11.6 |
| | 26 | 0.058 | 1.53 | 13.7 | 33.5 | 10.7 | 2.3 | 4.9 | 0.35 | — | — | 0.02 | 0.006 | Ce 0.06; Al 0.06; Ga 0.2 | 16.4 |
| | 27 | 0.03 | 0.35 | 3.28 | 33.1 | 24.0 | — | — | 0.03 | 0.12 | — | 0.05 | 0.006 | Ce 0.04; La 0.03; In 0.4 | 17.3 |
| | 28 | 0.046 | 0.52 | 1.51 | 18.0 | 10.7 | — | 5.7 | 0.02 | — | — | 0.02 | 0.007 | Y 0.02; Ce 0.05; Ga 0.3; In 0.4 | 20.1 |
| | 29 | 0.08 | 1.05 | 0.53 | 27.1 | 10.4 | 0.8 | — | 0.024 | 0.04 | 1.0 | 0.02 | 0.007 | Y 0.06; Ga 0.3 | 41.3 |
| | 30 | 0.13 | 2.11 | 2.51 | 22.1 | 10.4 | — | — | 0.03 | 0.61 | — | 0.02 | 0.006 | Ce 0.05; Al 5.3 | 63.5 |
| | 31 | 0.023 | 0.35 | 2.41 | 21.9 | 11.5 | — | — | 0.033 | 0.30 | 1.15 | 0.02 | 0.007 | Ca 0.009; Ga 0.1; In 0.6 | 12.0 |
| | 32 | 0.060 | 1.10 | 13.5 | 33.9 | 10.7 | 2.3 | 5.1 | 0.35 | — | — | 0.02 | 0.006 | Mg 0.03; Ga 1.0 | 14.9 |
| | 33 | 0.023 | 0.35 | 3.20 | 34.1 | 23.5 | — | — | 0.03 | 0.13 | — | 0.02 | 0.006 | Ca 0.008; Al 0.1; Ga 0.3 | 18.1 |
| | 34 | 0.05 | 0.51 | 1.55 | 18.0 | 11.1 | — | 5.2 | 0.02 | — | — | 0.05 | 0.008 | Ca 0.002; Mg 0.024; Al 0.2; Ga 0.1; In 0.1 | 22.0 |
| | 35 | 0.05 | 1.03 | 0.53 | 27.3 | 10.4 | 0.5 | — | 0.02 | 0.03 | 0.7 | 0.02 | 0.006 | Ca 0.007; In 0.4 | 42.1 |
| | 36 | 0.11 | 2.12 | 2.41 | 22.3 | 10.5 | — | — | 0.03 | 0.52 | — | 0.03 | 0.006 | Ca 0.005; Al 4.5 | 65.3 |

Table 3

| Steel Grade | Reduction of Area (%) at Testing Temperature (° C) 900 | 1000 | 1100 | 1200 | 1250 | Steel Grade | Reduction of Area (%) Testing Temperature (° C) 900 | 1000 | 1100 | 1200 | 1250 |
|---|---|---|---|---|---|---|---|---|---|---|---|
| 1 | 42 | 43 | 46 | 60 | 62 | 19 | 36 | 37 | 47 | 60 | 59 |
| 2 | 30 | 36 | 48 | 65 | 62 | 20 | 33 | 33 | 43 | 64 | 59 |
| 3 | 49 | 45 | 44 | 57 | 58 | 21 | 43 | 43 | 48 | 57 | 58 |
| 4 | 38 | 42 | 44 | 54 | 55 | 22 | 35 | 38 | 45 | 50 | 55 |
| 5 | 33 | 30 | 36 | 45 | 46 | 23 | 33 | 27 | 35 | 47 | 43 |
| 6 | 31 | 34 | 36 | 50 | 50 | 24 | 36 | 35 | 38 | 51 | 53 |
| 7 | 63 | 58 | 58 | 77 | 83 | 25 | 57 | 56 | 58 | 78 | 79 |
| 8 | 60 | 56 | 60 | 77 | 80 | 26 | 53 | 54 | 60 | 80 | 84 |
| 9 | 57 | 57 | 65 | 75 | 81 | 27 | 57 | 56 | 67 | 73 | 81 |
| 10 | 62 | 63 | 67 | 73 | 81 | 28 | 63 | 61 | 69 | 71 | 78 |
| 11 | 55 | 58 | 60 | 73 | 78 | 29 | 55 | 56 | 63 | 75 | 78 |

Table 3-continued

| Steel Grade | Reduction of Area (%) at Testing Temperature (° C) 900 | 1000 | 1100 | 1200 | 1250 | Steel Grade | Reduction of Area (%) Testing Temperature (° C) 900 | 1000 | 1100 | 1200 | 1250 |
|---|---|---|---|---|---|---|---|---|---|---|---|
| 12 | 59 | 55 | 57 | 70 | 74 | 30 | 52 | 52 | 60 | 71 | 72 |
| 13 | 57 | 54 | 61 | 75 | 77 | 31 | 54 | 55 | 62 | 74 | 73 |
| 14 | 63 | 62 | 67 | 74 | 74 | 32 | 59 | 62 | 72 | 76 | 79 |
| 15 | 54 | 56 | 62 | 59 | 75 | 33 | 55 | 56 | 66 | 76 | 85 |
| 16 | 60 | 56 | 61 | 63 | 77 | 34 | 58 | 60 | 67 | 73 | 80 |
| 17 | 55 | 56 | 65 | 73 | 74 | 35 | 54 | 55 | 63 | 69 | 68 |
| 18 | 61 | 59 | 60 | 69 | 69 | 36 | 57 | 58 | 66 | 75 | 77 |

What is claimed is:

1. A two-phase stainless steel composed of 10 to 75% of a ferrite phase and the balance an austenite phase, said steel consisting essentially of:

C = 0.005 to 0.2%
Si = 0.01 to 3.0%
Mn ≦ 15%
P ≦ 0.08%
S ≦ 0.03%
Cr = 15 to 35%
Ni = 10 to 30%
N = 0.01 to 0.4%
Al = 0.06 to 6.0% and at least one element selected from the group consisting of Y = 0.01 to 0.09%
Ce = 0.001 to 0.2% and Mg = 0.001 to 0.09%, and further comprising at least one of Nb ≦ 2.0%, Mo ≦ 6.0%, Ti ≦ 1.0% and Cu ≦ 3.0% with the balance Fe and unavoidable impurities and having a reduction of area of between 52% and 63% at 1,000° C.

* * * * *